United States Patent [19]

Bouko et al.

[11] Patent Number: 4,987,423

[45] Date of Patent: Jan. 22, 1991

[54] WIDE BAND LOOP ANTENNA WITH DISYMMETRICAL FEEDING, NOTABLY ANTENNA FOR TRANSMISSION, AND ARRAY ANTENNA FORMED BY SEVERAL SUCH ANTENNAS

[75] Inventors: Jean Bouko, Villemoisson; Richard Piglowski, Morsang Sur Orge, both of France

[73] Assignee: Thomson-CSF, Puteaux, France

[21] Appl. No.: 328,447

[22] Filed: Mar. 24, 1989

[30] Foreign Application Priority Data

Apr. 1, 1988 [FR] France ..... 88 04389

[51] Int. Cl.[5] ..... H01Q 7/00

[52] U.S. Cl. ..... 343/741; 343/742; 343/743; 343/846

[58] Field of Search ..... 343/741, 700 MS, 846, 343/742, 743

[56] References Cited

U.S. PATENT DOCUMENTS

| | | | |
|---|---|---|---|
| 4,051,477 | 9/1977 | Murphy et al. | 343/846 |
| 4,162,499 | 9/1979 | Jones et al. | 343/700 MS |
| 4,191,959 | 3/1980 | Kerr | 343/700 MS |
| 4,554,549 | 11/1985 | Fassett et al. | 343/700 MS |
| 4,719,470 | 1/1988 | Munson | 343/700 MS |

FOREIGN PATENT DOCUMENTS

| | | | |
|---|---|---|---|
| 2245195 | 5/1973 | Fed. Rep. of Germany | 343/742 |
| 2633757 | 4/1977 | Fed. Rep. of Germany MS | 343/700 |
| 107610 | 7/1982 | Japan | 343/700 MS |

*Primary Examiner*—Michael C. Wimer

*Attorney, Agent, or Firm*—Oblon, Spivak, McClelland, Maier & Neustadt

[57] ABSTRACT

Disclosed is a loop type antenna, fed by a coaxial line, comprising:

- a symmetrical, plane, loop-shaped radiating element enclosed on itself, connected to the core of the coaxial feed line at one point of the loop;
- a reflector plane extending in parallel to the plane of the loop and at a distance from it; and,
- a symmetrizer element in the shape of a metallic plate, placed between the loop and the reflector and extending in parallel to the plane of the loop and to that of the reflector plane, with a general shape substantially corresponding to the shape of that portion of the loop which is connected to the core of the coaxial line, this plate being connected to the ground of the coaxial feed line. The disclosure also concerns an array antenna comprising an ordered grouping of several antennas, excited simultaneously, said loop and said plate of each antenna extending over a common reflector plane.

10 Claims, 3 Drawing Sheets

WIDE BAND LOOP ANTENNA WITH DISYMMETRICAL FEEDING, NOTABLY ANTENNA FOR TRANSMISSION, AND ARRAY ANTENNA FORMED BY SEVERAL SUCH ANTENNAS

BACKGROUND OF THE INVENTION

1. Field of the Invention

The present invention concerns a loop type antenna with disymmetrical feeding.

2. Description of the Prior Art

The characteristics of loop antennas are known, in particular their wide passband and their relatively open radiation pattern which causes them to be used especially in reception.

In most cases the loop is used alone, i.e.; without any associated reflector, and it is fed either by a two-wire line, the two conductors of which go up to the two ends of the loop (which is not closed on itself), or by a coaxial line, the loop being connected to the line by the interposition of a symmetrizer device.

Currently used loop antennas are ill-suited for use in transmission because of their SWR (standing wave ratio) which is disadvantageous for the energy radiated.

Furthermore, if the output of the transmitter, as is usually the case, is done on a coaxial line, the use of the symmetrizer further increases the SWR. In addition, this approach enables suitable operation only in a relatively narrow frequency range (around the matching frequency of the symmetrizer), and this is incompatible with wide band transmission.

SUMMARY OF THE INVENTION

It is one of the objects of the present invention to propose a loop type antenna which can be fed by a coaxial line, notably for use in transmission, enabling excellent adaptation both as regards the SWR and the radiation pattern, on a relatively wide frequency range.

Furthermore, as shall be seen, the invention provides for an adapted radiating source which is simple to make and costs little, thus making it possible, if necessary, to increase the number of antennas so as to form a large-sized array ("slab" antenna) for high values of radiated power.

To this end, according to the present invention, the antenna, which is fed by at least one coaxial line, comprises:

- a symmetrical, plane, loop-shaped radiating element enclosed on itself, connected to the core of the coaxial feed line at one point of the loop;
- a reflector plane extending in parallel to the plane of the loop and at a distance from it, and,
- at least one symmetrizer element in the shape of a metallic plate, placed between the loop and the reflector and extending in parallel to the plane of the loop and to that of the reflector, with a general shape substantially corresponding to the shape of that portion of the loop which is connected to the core of the coaxial line, said plate being connected to the ground of the coaxial feed line.

Furthermore, according to a certain number of advantageous characteristics:

- said loop portion is a rectilinear segment, the biggest dimension of the rectangular plate being substantially equal to or smaller than the length of this facing loop segment; preferably the loop is then substantially square shaped;
- the length/width ratio of the rectangular plate is at least equal to 4;
- the distance from the plane of the plate to the plane of the loop is smaller than 1/10th of the wavelength;
- the ratio of the distance from the plane of the plate to the plane of the loop/distance from the plane of the plate to the plane of the reflector is approximately between 1:5 and 1:10;
- the distance from the plane of the loop to the plane of the reflector is substantially equal to or smaller than a half wavelength;
- the loop is fed, selectively or simultaneously, by a second coaxial line at a second feed point located substantially orthogonally, on the loop, with respect to the first feed point.

Another object of the invention is an array antenna formed by an ordered grouping of several antennas having the above-mentioned characteristic structure and being excited simultaneously, the loop and the plate of each antenna extending over a common reflector plane.

BRIEF DESCRIPTION OF THE DRAWINGS

Other features and advantages of the present invention will emerge from the following detailed description made with reference to the appended drawings, of which.

DESCRIPTION OF PREFERRED EMBODIMENTS

Figure 1:
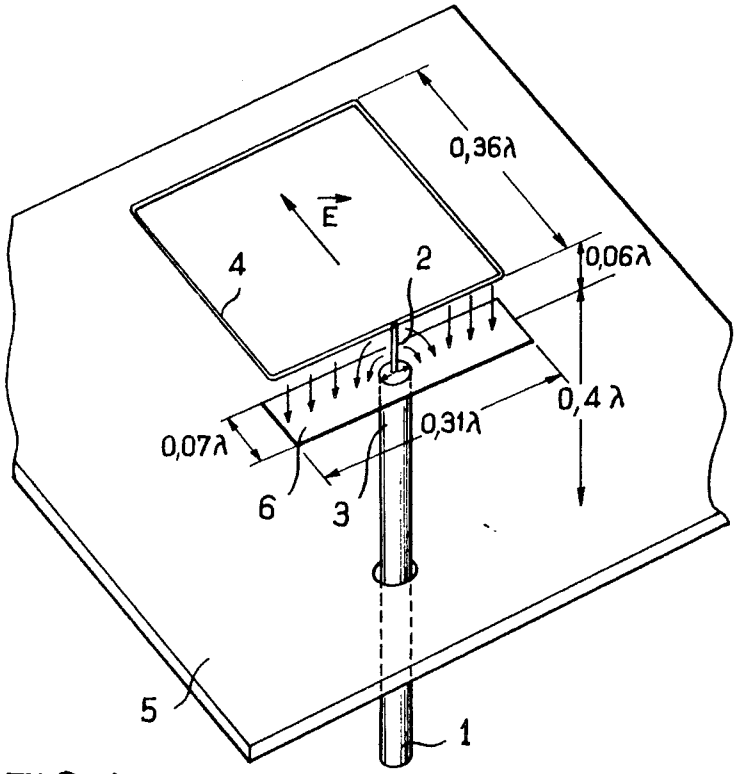
FIG. 1 gives a schematic view, in perspective, of the antenna of the present invention.

In FIG. 1, the reference 1 designates the feed line, which is a coaxial (hence disymmetrical) line, with a central conductor 2 forming the core of the cable and a peripheral conductor 3 forming a ground and return conductor.

The feed line ends in an antenna which comprises a loop 4, a plane reflector 5 and a symmetrizer element 6 in the form of a plate. Each of these three elements is a plane element, and the planes of the three elements are parallel to one another.

The loop 4 is preferably square-shaped, and is entirely closed on itself. It is excited by the core 2 of the coaxial line which is connected, at a median point, to one of the sides of the loop, so as to preserve the symmetrical structure proper to loop antennas.

A plane reflector 5 is placed below the antenna. Its dimensions are not of critical importance, and this reflector extends towards infinity.

To provide for the transition between the loop-reflector symmetrical structure and the disymmetrical feed line, there is provision a symmetrizer adapting element formed by a metallic plate 6 placed between the loop and the reflector, at a small distance from the loop, and connected to the ground 3 of the feed line.

The effect of this plate 6 is to extend the ground of the coaxial line in the form of a ground plane that provides for the coupling with the loop, because this plane is in the close vicinity of one of the sides of the loop. FIG. 1 has arrows showing the direction of the field lines between the loop 4 and the reflector 6, thus giving a visual picture of how the transition is achieved between the disymmetrical feeding and the symmetrical radiating element.

Preferably, the plate 6 is shaped like an elongated, rectangular plate extending in parallel to one of the sides of the square formed by the loop 4, the length of the plate being of the same order as the length of this side, and preferably slightly smaller.

FIG. 1 gives the respective, preferred dimensions of the different elements. These dimensions are all given as a function of the wavelength of the central frequency of the operating band of the antenna.

Figure 2:
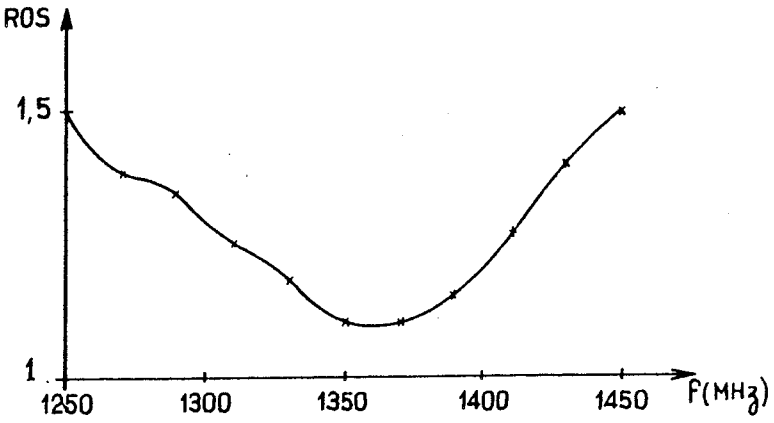
FIG. 2 is a curve showing the variation in SWR over a wide range of frequencies.
Figure 3:
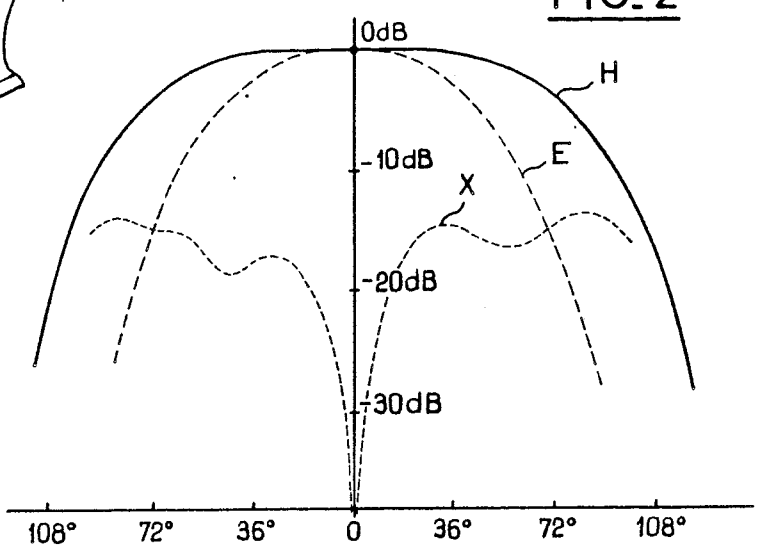
FIG. 3 shows various radiation patterns measured for the antenna of FIG. 1.

FIGS. 2 and 3 give the results of measurements made with an antenna having the characteristics and dimensions indicated in FIG. 1.

FIG. 2 shows the variation of the SWR as a function of frequency on the 1240–1450 MHz band, and it can be seen that the SWR stays always smaller than 1.5 throughout the band, thus enabling the antenna of the present invention to be used very appropriately for wide band transmission (in the case of FIG. 2, the frequency varies by ±7.5% around the central frequency).

FIG. 3 shows the respective radiation patterns, namely in the plane containing the electrical field (curve E), i.e. in the plane perpendicular to the loop and to the side fed by the coaxial line (it will be, for example, the bearing pattern, the loop and the side fed by the coaxial line being vertical); in the plane orthogonal to the preceding one, containing the magnetic field (curve H which will be the elevation angle pattern if we retain the previous assumption); and the pattern corresponding to a crossed polarization (curve X). As can be seen, the gain of the antenna remains homogenous over a relatively wide-angle opening.

Figure 4:
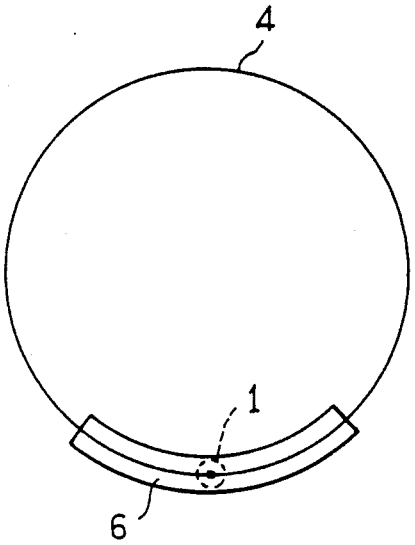
FIG. 4 shows a plane view of an alternative embodiment wherein the loop is circular.
Figure 6:
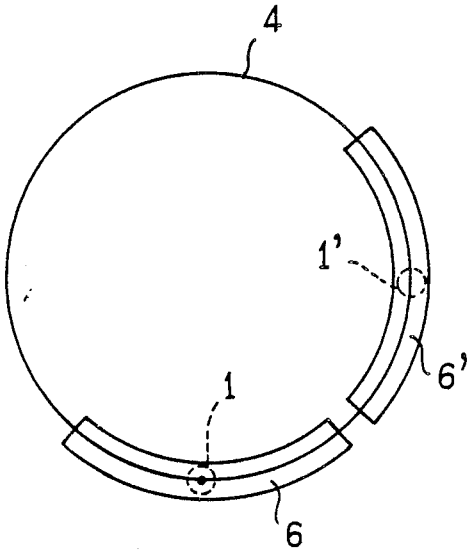

It will be noted that the loop is not necessarily square or rectangular. As an alternative, it may have a curved part in the vicinity of the excitation point, or it may even be completely circular as shown in FIG. 4, the plate 6 being then curved to follow the contour of the curved part around the excitation point.

Figure 5:
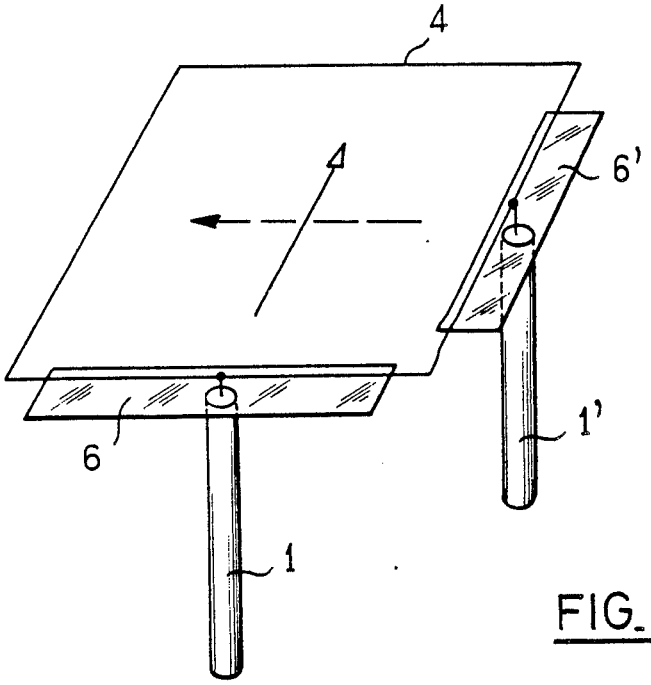
FIG. 5 gives a view, similar to that of FIG. 1, of an embodiment in which the loop is excited separately at two points by two different coaxial lines, and, FIG. 6 shows a view, similar to that of FIG. 4, of the embodiment of FIG. 5.

Furthermore, as shown in FIGS. 5 (square loop) and 6 (circular loop), the loop 4 may be fed by a second coaxial line 1' located on the loop at 90° to the first coaxial line 1. There is then provided, as for the first coaxial line, a plate 6' forming a symmetrizer element.

The two coaxial lines can be used either selectively (it is then possible, depending on the coaxial line chosen for the excitation, to obtain a vertical or horizontal polarization), or simultaneously, with a phase shift of $\pi/2$ between the two feed signals of the loop (a circular polarization can then, be obtained).

Figure 7:
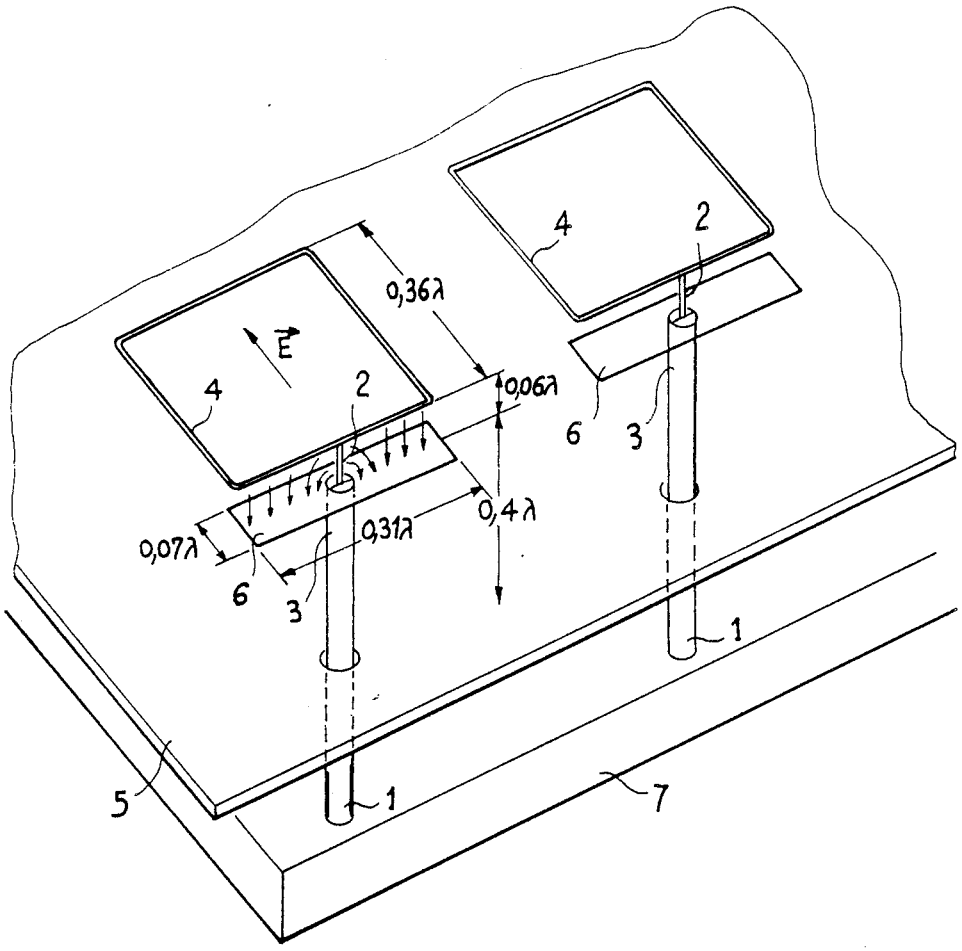
FIG. 7 shows a plurality of antenna elements on top of a common reflector plane.

Finally, as shown in FIG. 7, it is possible to provide, on top of a common reflector plane, for several loop/plate sets arranged so as to form an array and fed simultaneously (possibly with an appropriate phase shift) so that it is possible to radiate greater power and/or to modify the radiation pattern in playing on the relative phase shifts of excitation of the different elements of the array, as is well known in the prior art.

What is claimed is:

1. A loop type antenna system, fed by at least one coaxial line, having a core and a peripheral conductor, said antenna system comprising:

at least one symmetrical, plane, radiating element in the form of a closed loop with a first feed point thereon, said feed point being connected to said core of said coaxial feed line;

a planar reflector extending in plane parallel to the plane of said loop and at a distance from it; and at least one symmetrizer element in the shape of a metallic plate, placed between said loop and said planar reflector and extending in parallel to the plane of the loop and to that of the planar reflector, with a general shape substantially corresponding to the shape of a predetermined portion of said loop comprising said feed point, said plate being connected to said peripheral conductor of said coaxial feed line.

2. An antenna according to claim 1, wherein said loop portion is a rectilinear segment, said plate being rectangular and its greatest dimension being substantially equal to or smaller than the length of said loop portion.

3. An antenna according to claim 2, wherein the symmetrical plane loop is substantially square shaped.

4. An antenna according to claim 2, wherein the length/width ratio of said plate is at least equal to 4.

5. An antenna according to claim 1, wherein the distance from the plane of said plate to the plane of said loop is smaller than 1/10th of the operating wavelength.

6. An antenna according to claim 5, wherein the ratio between the distance from the plane of said plate to the plane of said loop and the distance from the plane of said plate to the plane of said reflector is between about 1:5 to 1:10.

7. An antenna according to claim 6, wherein the distance from the plane of said loop to the plane of said reflector is substantially equal to or smaller than a half wavelength.

8. An antenna according to claims 1, 2, 3, 4, 5, 6, or 7, wherein the loop is fed by a second coaxial line at a second feed point located substantially orthogonally on the loop with respect to said first feed point.

9. An antenna system according to claims 1, 2, 3, 4, 5, 6, or 7, further comprising an ordered grouping of a plurality of antennas each comprising said at least one radiating element and said at least one symmetrizer element and fed simultaneously, with each of said antennas in said system arranged so that said loop and said plate extend over a common reflector plane.

10. An antenna system according to claim 8 further comprising an ordered grouping of a plurality of antennas each comprising said at least one radiating element and said at least one symmetrizer element and fed simultaneously, with each of said elements in said system arranged so that said loop and said plate extend over a common reflector plane.

* * * * *